US011787513B2

(12) United States Patent
Rudofsky

(10) Patent No.: US 11,787,513 B2
(45) Date of Patent: Oct. 17, 2023

(54) RETRACTABLE HANDLEBARS FOR USE ON MOTORIZED SURF BOOTS

(71) Applicant: Keith Maximilian Rudofsky, Fort Lauderdale, FL (US)

(72) Inventor: Keith Maximilian Rudofsky, Fort Lauderdale, FL (US)

( * ) Notice: Subject to any disclaimer, the term of this patent is extended or adjusted under 35 U.S.C. 154(b) by 79 days.

(21) Appl. No.: 17/238,144

(22) Filed: Apr. 22, 2021

(65) Prior Publication Data

US 2022/0063770 A1 Mar. 3, 2022

Related U.S. Application Data

(60) Provisional application No. 62/986,660, filed on Mar. 7, 2020.

(51) Int. Cl.
*B63B 34/10* (2020.01)
*B63H 25/02* (2006.01)

(52) U.S. Cl.
CPC ..... *B63B 34/10* (2020.02); *B63H 25/02* (2013.01); *B63H 2025/024* (2013.01)

(58) Field of Classification Search
CPC .... B63B 34/10; B63H 25/02; B63H 2025/024
See application file for complete search history.

(56) References Cited

U.S. PATENT DOCUMENTS 3,144,849 A * 8/1964 Maser ..... B63B 32/10 114/55.54
4,744,584 A * 5/1988 Monreal ..... A63C 9/00 280/809
5,643,029 A * 7/1997 Rudofsky ..... B63B 34/10 441/76
2022/0063770 A1* 3/2022 Rudofsky ..... B63H 25/02

* cited by examiner

*Primary Examiner* — S. Joseph Morano
*Assistant Examiner* — Jovon E Hayes

(57) ABSTRACT

In water or on land, an innovative Dual Retractable Handlebar System with adjustable damping, allows the rider of Motorized Surf Boots to transition from a kneeling, to squatting, to standing, or vice versa, in one smooth articulated motion while keeping a continued grip on the handles and throttles.

Each handlebar of the pair is firmly connected to each boot (or board) safely behind the rider, with each handlebar extending around the outside of the rider to a comfortable and ergonomic position to grasp with each hand, providing the rider with the ability to impart body English on the left and right sides independently, in order to effectively steer his or her Motorized Surf Boots on water or on land.

Additionally, the pair of Handlebars of the present invention can be quickly locked in the retracted (or down) position, or quickly released for deployment in a range of up positions.

6 Claims, 6 Drawing Sheets

RETRACTABLE HANDLEBARS FOR USE ON MOTORIZED SURF BOOTS

CROSS-REFERENCE TO RELATED PATENTS

The present invention offers an instrumental steering improvement to the prior art of USPTO Rudofsky U.S. Pat. No. 5,643,029 Motorized Surf Boots, as described in column 4, lines 44-46 and 48-51.

BACKGROUND OF THE INVENTION

From PTO U.S. Pat. No. 5,643,029 Motorized Surf Boots, column 4, lines 44-46 and 48-51 "FIG. 5-10 additionally show four other pivot-couplings 76 as part of a framework 78, of which the throttle controls 48 form a part . . . ", "As illustrated, the frame network 78 is positioned forwardly of the boots 28 on each board, and are at a height to place the throttle controls 48 in easy grasp of a user's hands."

In operation of Motorized Surf Boots it was found that the said frame network was ineffective in enabling the rider to kneel, squat, or bend, in the process of standing erect on said boards. Also ineffective was the ability to rely on the frame network for bodily support or to impart body English into the boards to aid in steering.

BRIEF SUMMARY OF THE INVENTION

It is also an object of the invention to provide the rider a pair of handlebars, a left side and a right side, each with its own handles and throttles mounted, that can continue to be grasped by a rider while he or she transitions from a kneeling, to a squatting, to a standing position, and vice versa, while on the pair of boards.

It is another object of the invention to provide the rider the ability to quickly lock the pair of handlebar assemblies in the retracted (or down) position, or to quickly release the pair of handlebars for movement into the deployed (or up) position, at will.

It is another object of the invention to provide a pair of handlebars that include a predetermined resistance force (or damping force) during up or down deployment, that is adjustable by the rider.

It is another object of the invention to provide handlebars that fold, or are telescopic, in order to make the handlebars adjustable according to the length preferences of the rider.

It is another object of the invention to provide a pair of handlebars that can support the load force imparted by the rider in order to influence the angle or orientation of the Surf Boots (as the rider imparts Body English into them) in order to steer effectively.

BRIEF DESCRIPTION OF THE SEVERAL VIEWS OF THE DRAWINGS

These and other features of the present invention will be more clearly understood from a consideration of the description, taken in connection with the accompanying drawings, in which.

DETAILED DESCRIPTION OF THE INVENTION

Figure 1:
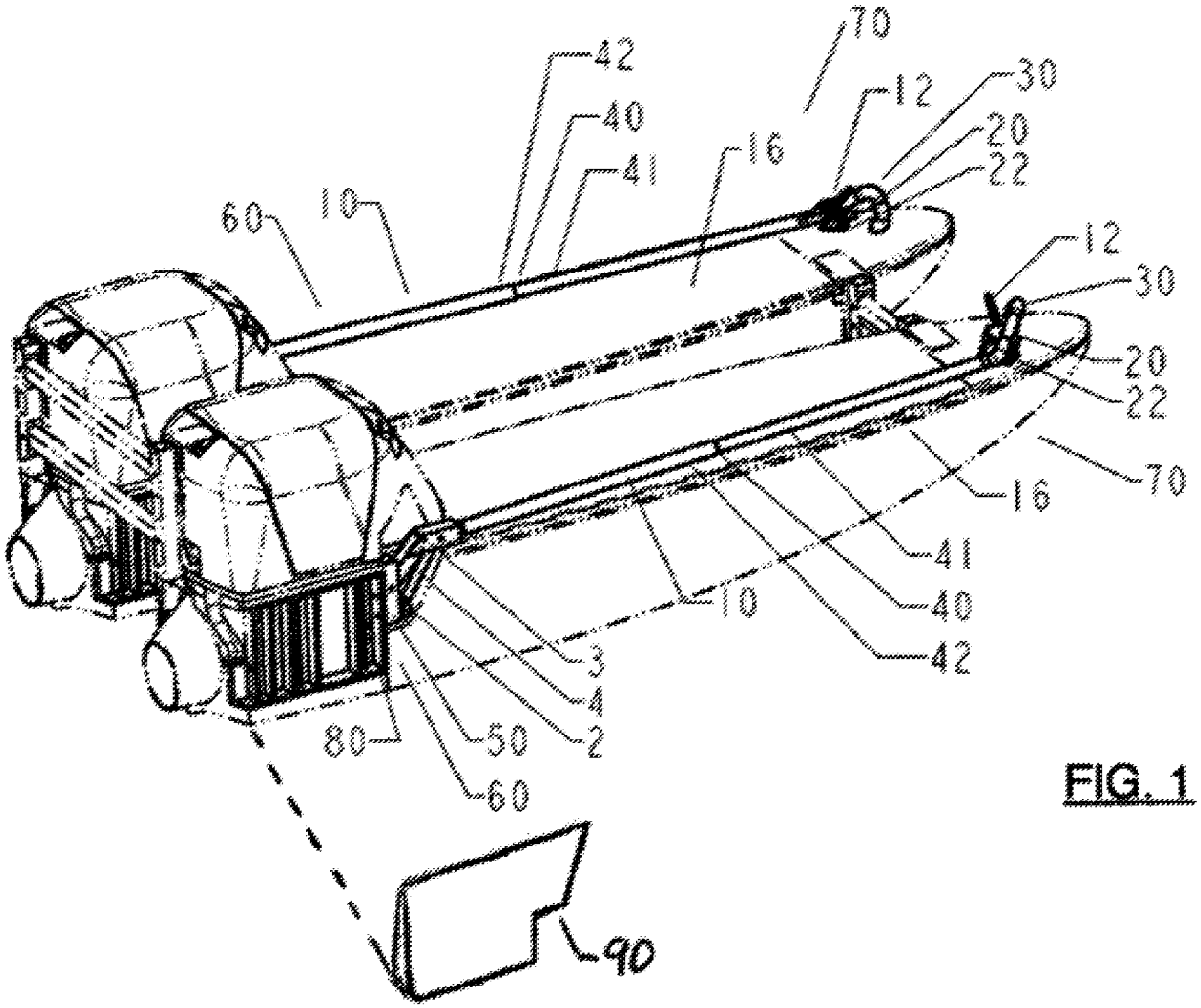
FIG. 1 is a rear perspective view of the embodiment of motorized surf boots for use in the water, with the handlebar assemblies shown in the retracted/or down position.
Figure 2:
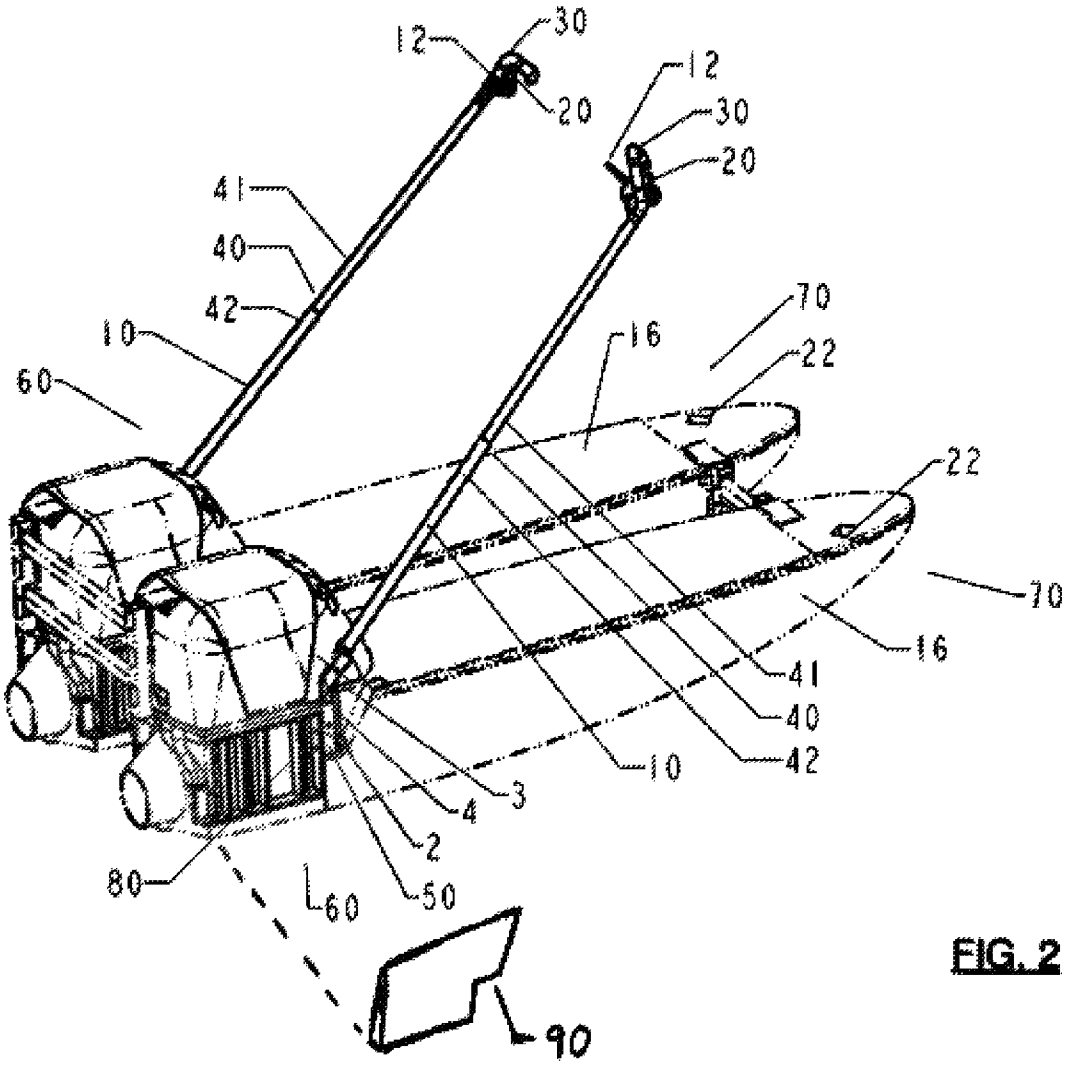
FIG. 2 is a rear perspective view of the embodiment of motorized surf boots for use in the water, with the handlebar assemblies shown in the deployed/up position.
Figure 3:
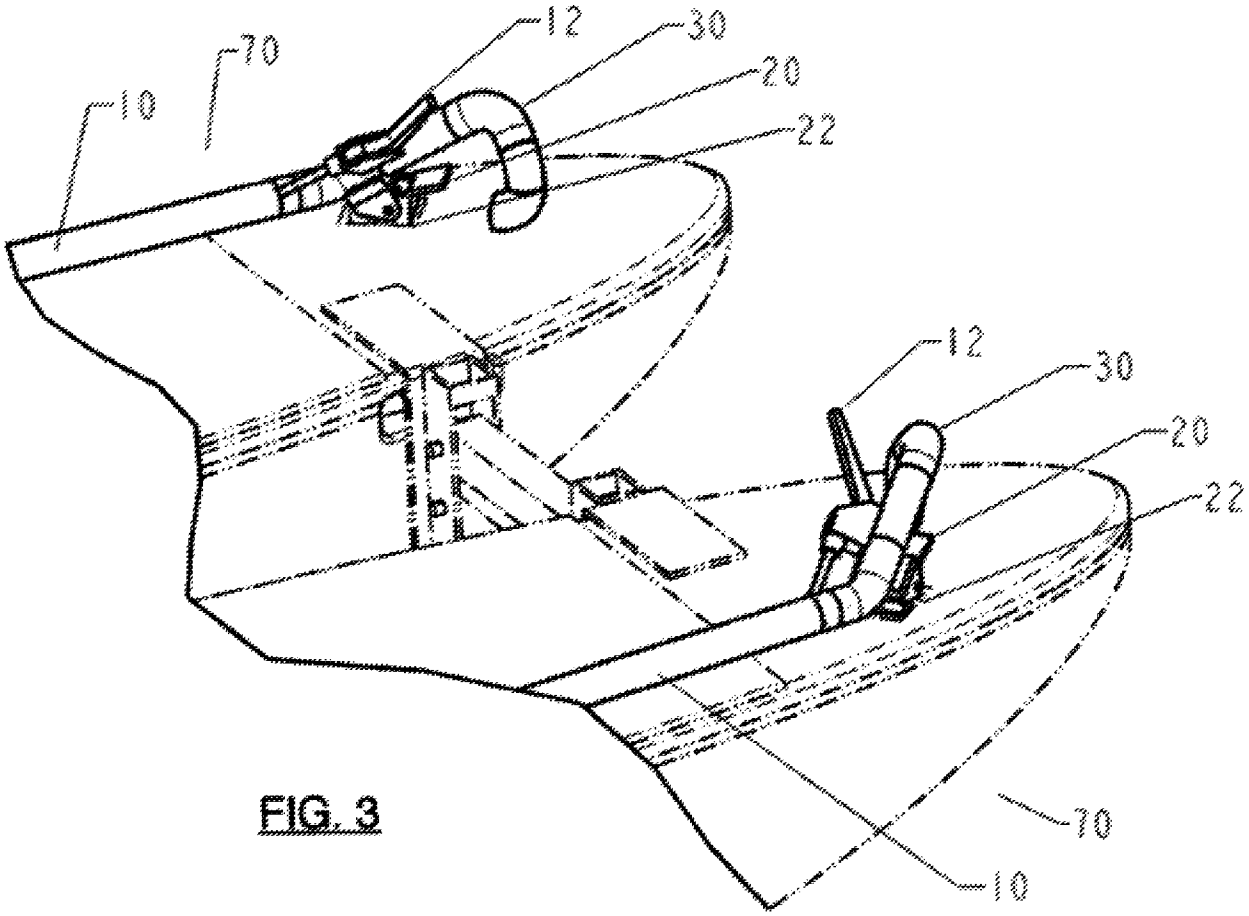
FIG. 3 is the perspective of FIG. 1 showing a close-up of the handles of the handlebar assemblies. The handlebars are shown in the locked/stowed or down position, showing the detail of the quick release/lock lever. The throttles are also shown.
Figure 4:
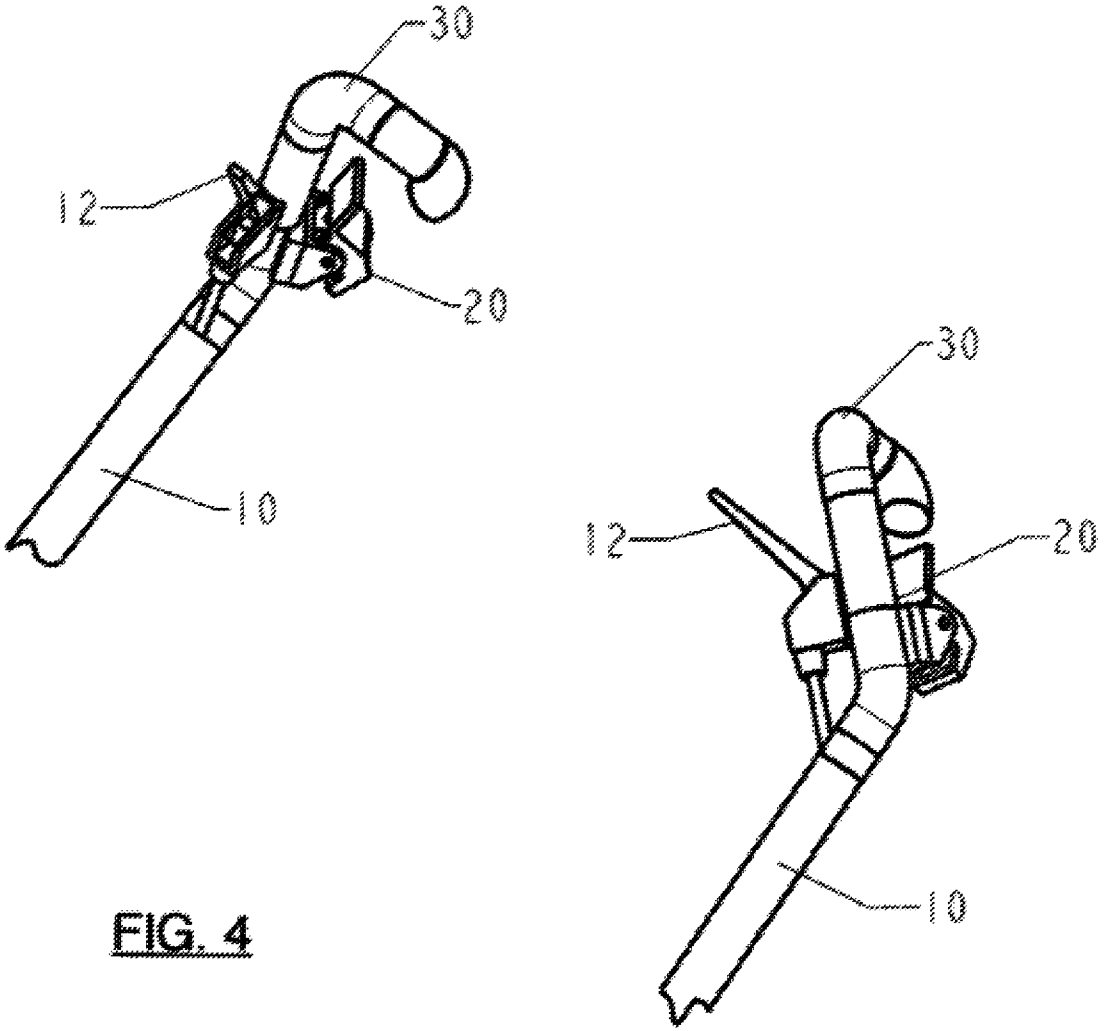
FIG. 4 is the perspective of FIG. 2 showing a close-up of the handles of the handlebar assemblies. The handlebars are shown in the deployed/or up position, showing the detail of the quick release/lock lever. The throttles are also shown.
Figure 5:
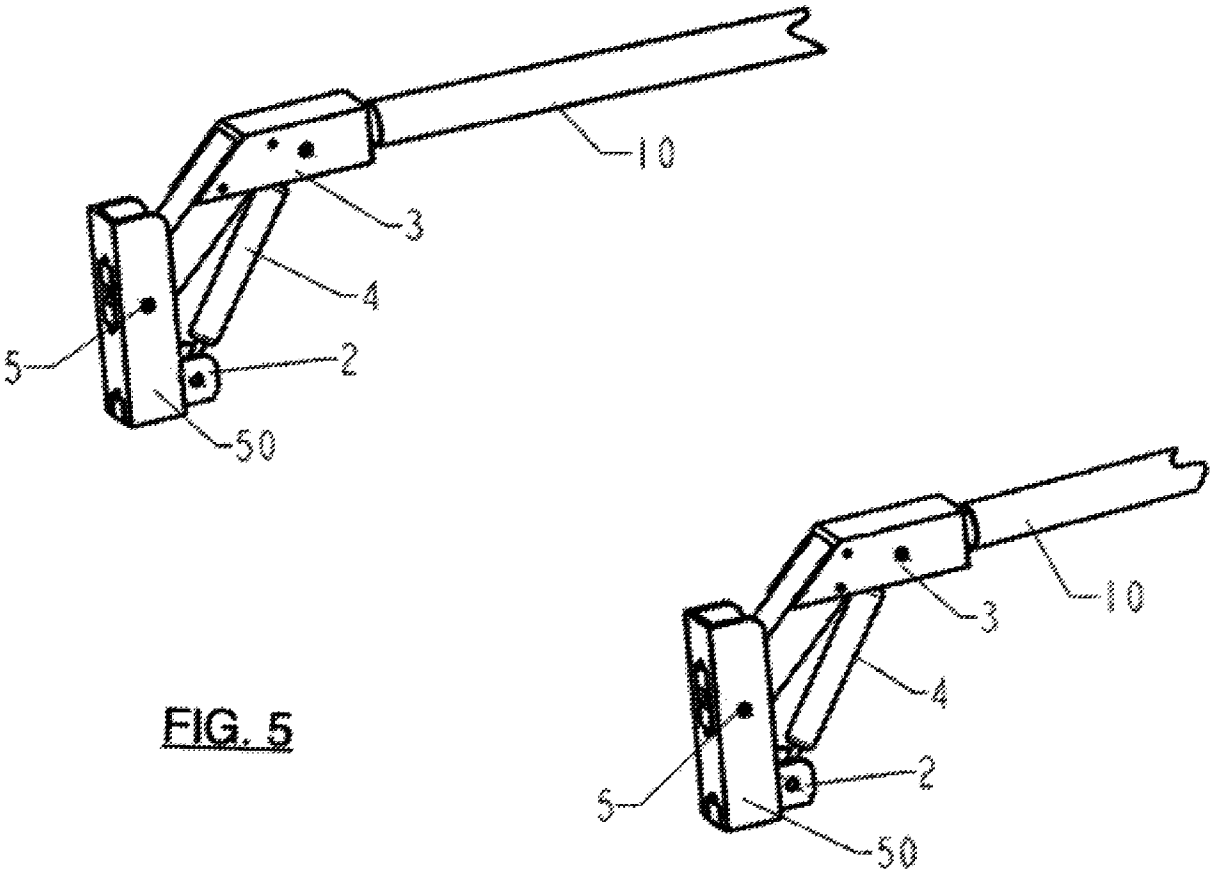
FIG. 5 is the rear perspective of FIG. 1, showing the handlebar assemblies by themselves, in the retracted/stowed/or down position. A gas spring (or damping device) is shown in its compressed state.
Figure 6:
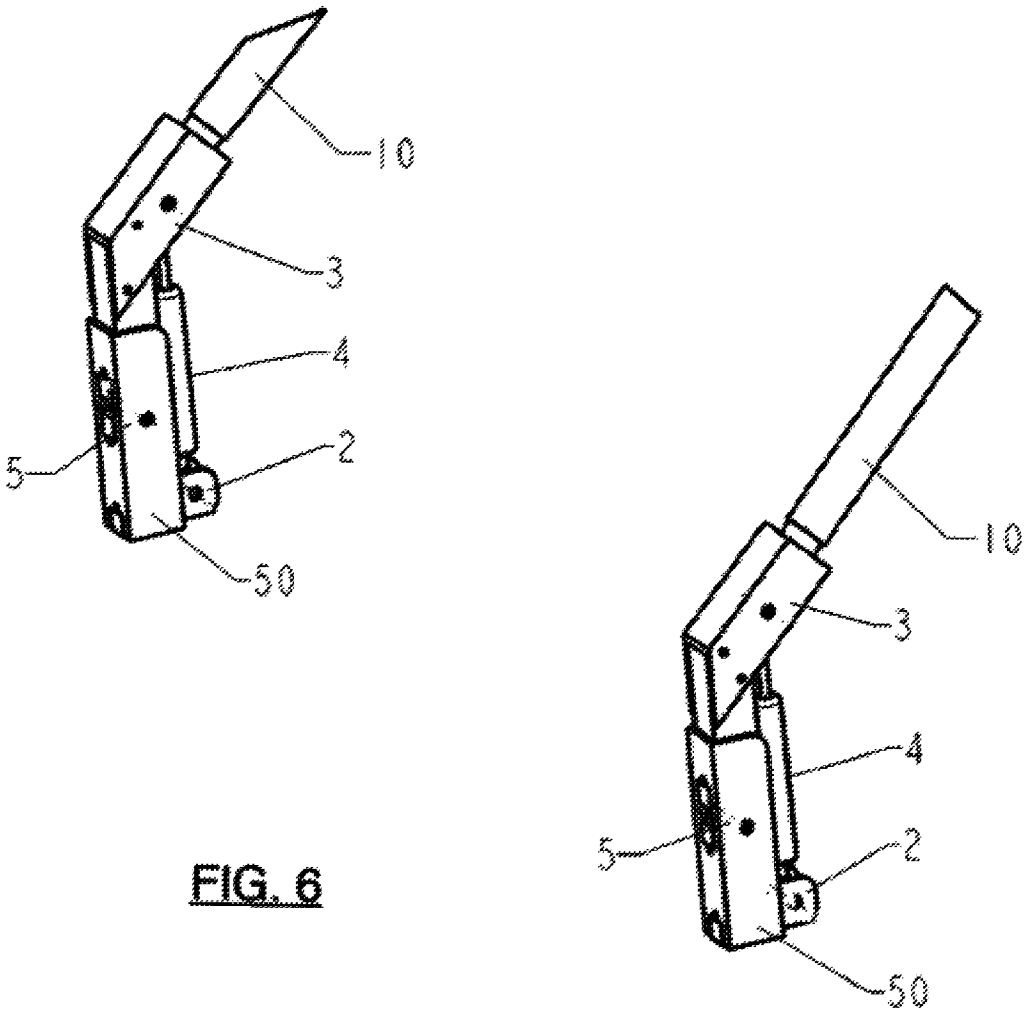
FIG. 6 is the rear perspective of FIG. 2, showing the handlebar assemblies by themselves, in the deployed/up position. A gas spring (or damping device) is shown in the maximum extended position.

In the embodiment of the invention shows in FIGS. 1-8, and their subparts, for use in a water environment each handlebar assembly is illustrated by the reference numeral 10, as extending from its attachment location 60 on each board 16, to a location at the front of the boards 70.

The throttle lever 12 is then attached to the extended handle 30 of the handlebar thereby. The handlebars will be seen to accommodate mechanical or electronic throttles.

In addition to providing a mount for the throttle mechanisms 12, each handle 30 of the handlebar assemblies 10, shall provide an additional pair of hand or finger control levers that unlock and relock the handlebar assemblies 10 from the down/or locked position. Using a spring-loaded lever 20, when the lever 20 is depressed, the lever will release from the mating feature 22 embedded in each of the boards 16 thereby.

The handle 30 of the handlebar assembly 10 is so designed so as to provide for the rider to grasp the handle 30 and actuate the throttle 12 and/or the quick release and relock feature 20, while transitioning from a squatting position, to a kneeling position, to a standing position, and vice versa.

The retracting mechanism 50 of each handlebar assembly 10 is composed of a fixed bracket 2, and a pivoting bracket 3. The pivoting bracket 3 is pivoted by the use of a commonly used gas spring (or other appropriate spring/damping device) 4. When the rider releases the handlebars 10 from the lever mating feature 22, the gas spring 4 will cause the bracket 3 to pivot about its attachment axis 5, with an adjustable force.

The retracting mechanism 50 that provides for the movement of the handlebars to pivot into the deployed/or up position, is shown attached to the outside of each board 16, behind the rider thereby. The fixed bracket 2 of the retracting mechanism is then attached to a load bearing structural member 80 of the Motorized Surf Boots, so as to provide the rider the ability to impart body English into the boards to influence the direction of motion of said boards. The fixed bracket 2 can be attached by bolts and nuts, or by any other suitable attachment scheme. The structural members 80 can be comprised of any suitable construction to bear the loads imparted by handlebar system 10 in order to effectively steer the boards 16. The retracting mechanism 50 shall be located so as maximize portability while minimizing interference with the rider climbing on or off the pair of boards.

A cover plate 90 is shown to cover the handlebar retraction mechanism 50 and the attachment structure 80. The cover plate can be fashioned out of any material and attached in any appropriate manner. Additionally, the cover plate 90 can include features to increase buoyancy, and maneuverability.

It will be readily appreciated by those skilled in the art that modifications can be made without departing from the scope of the teachings herein. Therefore, resort should be had to the claims appended hereto for a true understanding of the scope of the invention.

I claim:

1. A pair of handlebar assemblies for steering the pair of boards of a pair of motorized surf boots, comprising:

a pair of handlebars, each handlebar of predetermined width and shape, and telescopic in length;

a pair of handles, each handle attached to the extended end of each said handlebar of said pair of handlebars; and a pair of retracting mechanisms, each retracting mechanism comprising a fixed bracket and a pivoting bracket, the fixed bracket attached to the rearward outboard side structure of each board of said pair of boards outside and rearward of a rider thereby, and a pivoting bracket for attaching the lower end of each said handlebar of said pair of handlebars, thus allowing a rider to hold each said handle of said pair of handles and pivot each said handlebar of said pair of handlebars in an up or down range of motion.

2. The handlebar assemblies of claim 1 wherein a pair of throttles are included, each throttle attached to a said handle of said pair of handles.

3. The handlebar assemblies of claim 1 wherein a pair of levers are included, each lever attached to each said handle of said pair handles, for use in locking each said handlebar in a down position or unlocked each said handlebar from a down positions.

4. The handlebar assemblies of claim 1 wherein an adjustable gas spring is attached to said fixed and said pivoting bracket of each said retracting mechanism of said pair of retracting mechanisms.

5. The handlebar assemblies of claim 1 wherein a spring is attached to said fixed bracket and said pivoting bracket of each said retracting mechanism of said pair of retracting mechanisms.

6. The handlebar assemblies of claim 1 wherein a clamping device is attached to said fixed bracket and said pivoting bracket of each said retracting mechanism of said pair of retracting mechanisms.

* * * * *